US011040566B2

(12) United States Patent
Brelje

(10) Patent No.: US 11,040,566 B2
(45) Date of Patent: Jun. 22, 2021

(54) PEN DISPENSER WITH PLASTIC SPRING ACTUATOR

(71) Applicant: LB USA FLEXIBLES, INC., Bolingbrook, IL (US)

(72) Inventor: Loren L. Brelje, Glencoe, MN (US)

(73) Assignee: LB USA FLEXIBLES, INC., Bolingbrook, IL (US)

( * ) Notice: Subject to any disclaimer, the term of this patent is extended or adjusted under 35 U.S.C. 154(b) by 0 days.

(21) Appl. No.: 16/546,477

(22) Filed: Aug. 21, 2019

(65) Prior Publication Data

US 2020/0062020 A1 Feb. 27, 2020

Related U.S. Application Data

(60) Provisional application No. 62/720,524, filed on Aug. 21, 2018.

(51) Int. Cl.
*B43K 1/06* (2006.01)
*B43K 5/00* (2006.01)

(52) U.S. Cl.
CPC ..... *B43K 1/06* (2013.01); *B43K 5/005* (2013.01)

(58) Field of Classification Search
CPC ..... B43K 5/1845; B43K 1/06; B43K 8/04; B43K 8/12; B43K 8/143; B43K 8/18; B65D 47/248; B65D 47/247
USPC ..... 401/206, 264
See application file for complete search history.

(56) References Cited

U.S. PATENT DOCUMENTS 2,210,662 A * 8/1940 Garvey ..... B43K 5/1845 401/206
3,468,611 A * 9/1969 Ward ..... B43M 11/06 401/186
3,661,468 A * 5/1972 Schwartzman ..... A61M 35/006 401/206
4,792,252 A * 12/1988 Kremer ..... A45D 34/04 401/205
5,615,963 A * 4/1997 Kobayashi ..... B05C 17/002 401/199
7,704,003 B2 * 4/2010 Ziniti ..... B43K 8/022 401/206
8,979,411 B2 * 3/2015 Ballot ..... B43K 5/1845 401/206
9,211,756 B2 * 12/2015 Ballot ..... B65D 47/248
2010/0296858 A1 * 11/2010 Richards ..... B65D 47/248 401/206
2013/0170887 A1 * 7/2013 Gillum ..... B43K 5/1845 401/143

* cited by examiner

*Primary Examiner* — David P Angwin
*Assistant Examiner* — Bradley S Oliver
(74) *Attorney, Agent, or Firm* — McAndrews, Held & Malloy, Ltd.

(57) ABSTRACT

A pen dispenser is provided with a tube having an open top for holding a fluid to be dispensed. A valve housing made of plastic and having channels on an inner wall is also provided. There is also an applicator nib made of plastic, along with a plastic spring actuator having a plastic button, and a button retainer. In a closed position the plastic spring actuator is sealingly engaged to the valve housing blocking the flow of fluid out around the applicator nib, and in the open position, the plastic spring actuator is depressed so it is no longer sealingly engaged to the valve housing, allowing the fluid to flow through the channels on the inner wall and exit the dispenser around the applicator nib.

9 Claims, 9 Drawing Sheets

PEN DISPENSER WITH PLASTIC SPRING ACTUATOR

CROSS-REFERENCE TO RELATED APPLICATIONS

This Application claims the benefit of and priority to U.S. Provisional Application No. 62/720,524, filed Aug. 21, 2018, the entire contents of which are herein incorporated by reference.

STATEMENT REGARDING FEDERALLY SPONSORED RESEARCH

Not Applicable.

BACKGROUND OF THE INVENTION

Heretofore, pen dispensers have used a metal spring. There remains a need in the field to replace the metal spring with a plastic spring actuator. Without limiting the scope of the invention a brief summary of some of the claimed embodiments of the invention is set forth below. Additional details of the summarized embodiments of the invention and/or additional embodiments of the invention may be found in the Detailed Description of the Invention, below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a pen dispenser is provided with a tube having an open top for holding a fluid to be dispensed. A valve housing made of plastic and having channels on an inner wall is also provided. There is also an applicator nib made of plastic, along with a plastic spring actuator having a plastic button, and a button retainer. In a closed position the plastic spring actuator is sealingly engaged to the valve housing blocking the flow of fluid out around the applicator nib, and in the open position, the plastic spring actuator is depressed so it is no longer sealingly engaged to the valve housing, allowing the fluid to flow through the channels on the inner wall and exit the dispenser around the applicator nib.

DETAILED DESCRIPTION OF THE INVENTION

Figure 1B:
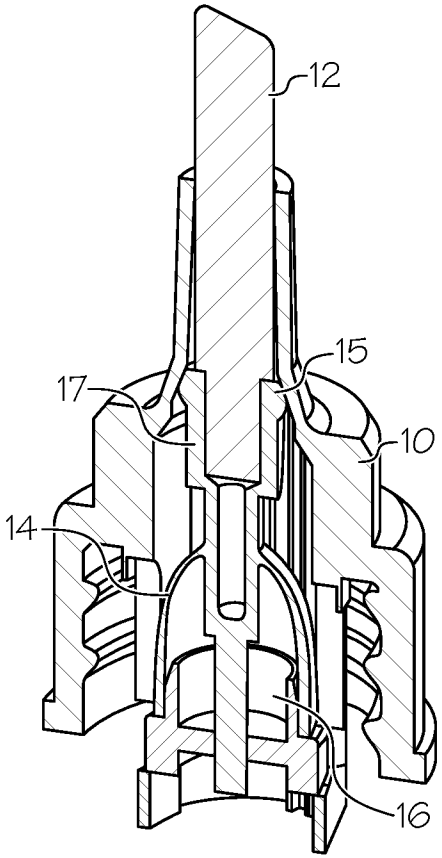
FIG. 1*b* show a cross-section view of FIG. 1*a*.
Figure 1A:
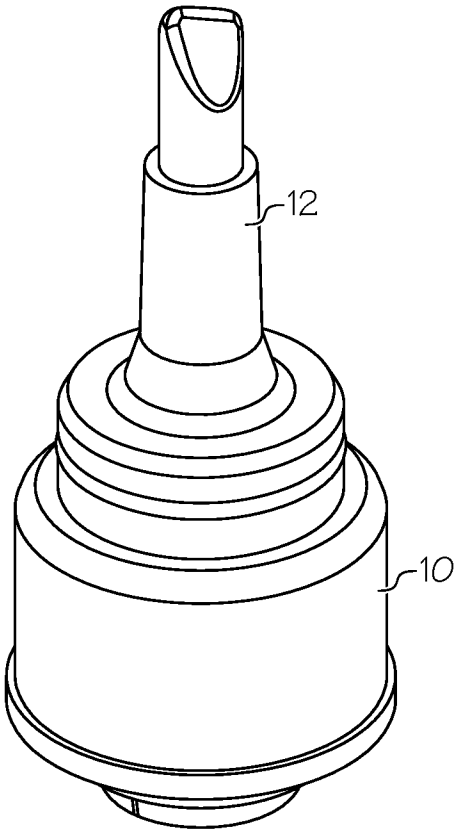
FIG. 1*a* shows the valve body and Nib of the pen dispenser.

Referring to FIG. 1*a*, the valve body with Nib is shown. FIG. 1*b* shows a cross sectional view of FIG. 1*a*, in which the valve body is shown at 10, and the Nib is shown at 12. The bottom of Nib 12 fits into spring actuator 17, which is formed in one piece with button 14. Button retainer 16 holds the bottom edge of button 14 in place, and when the Nib 12 is depressed, the valve seal formed by the top edge of spring 17 with the inner wall of valve body 10 (shown at 15), is opened and the liquid from the pen dispenser tube (shown below) can flow out around Nib 12. The elastic button 14 can be made of thermoplastic elastomer, which allows the button to be depressed, as shown and discussed further below.

Figure 2:
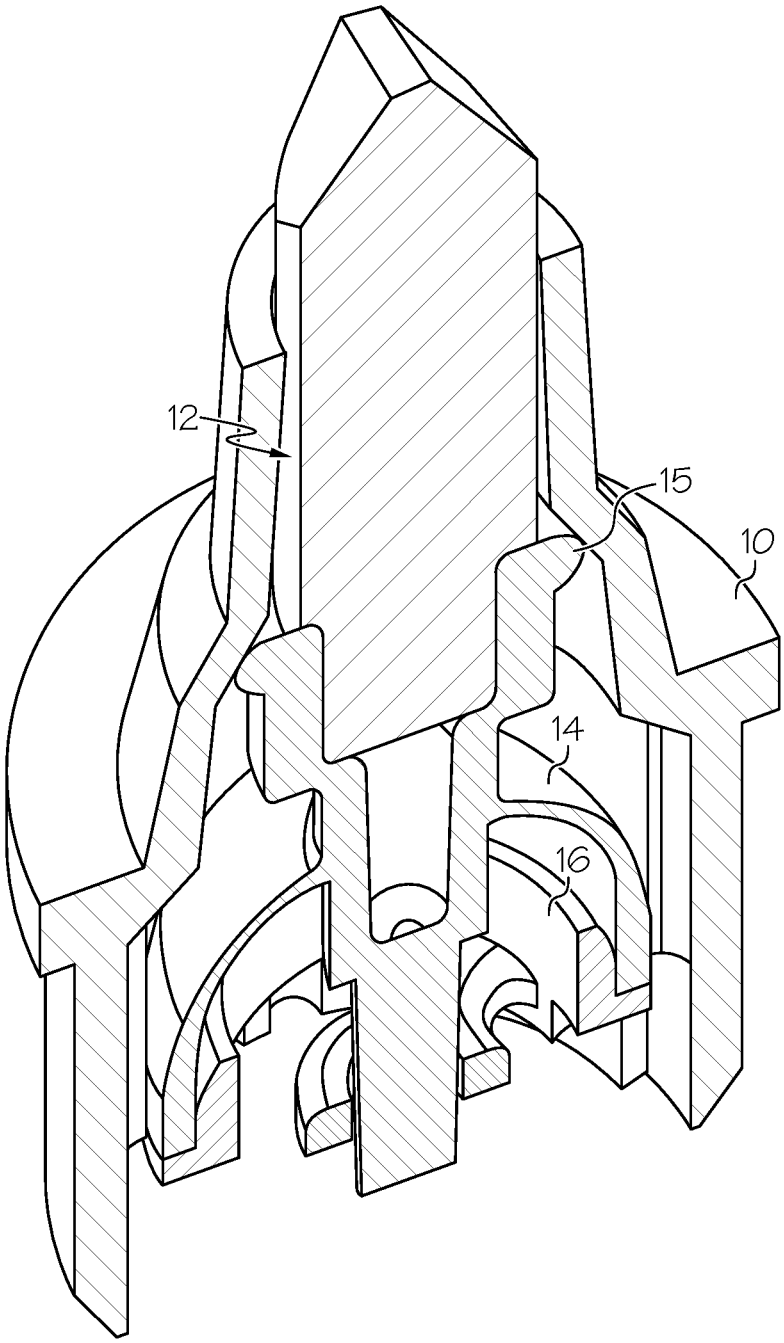
FIG. 2 show an enlarged view of FIG. 1*b*.

Referring to FIG. 2, an enlarged cross-section view is shown. The flow path is shown above 15, between the Nib 12 and the inner wall of the valve body 10.

Figure 3:
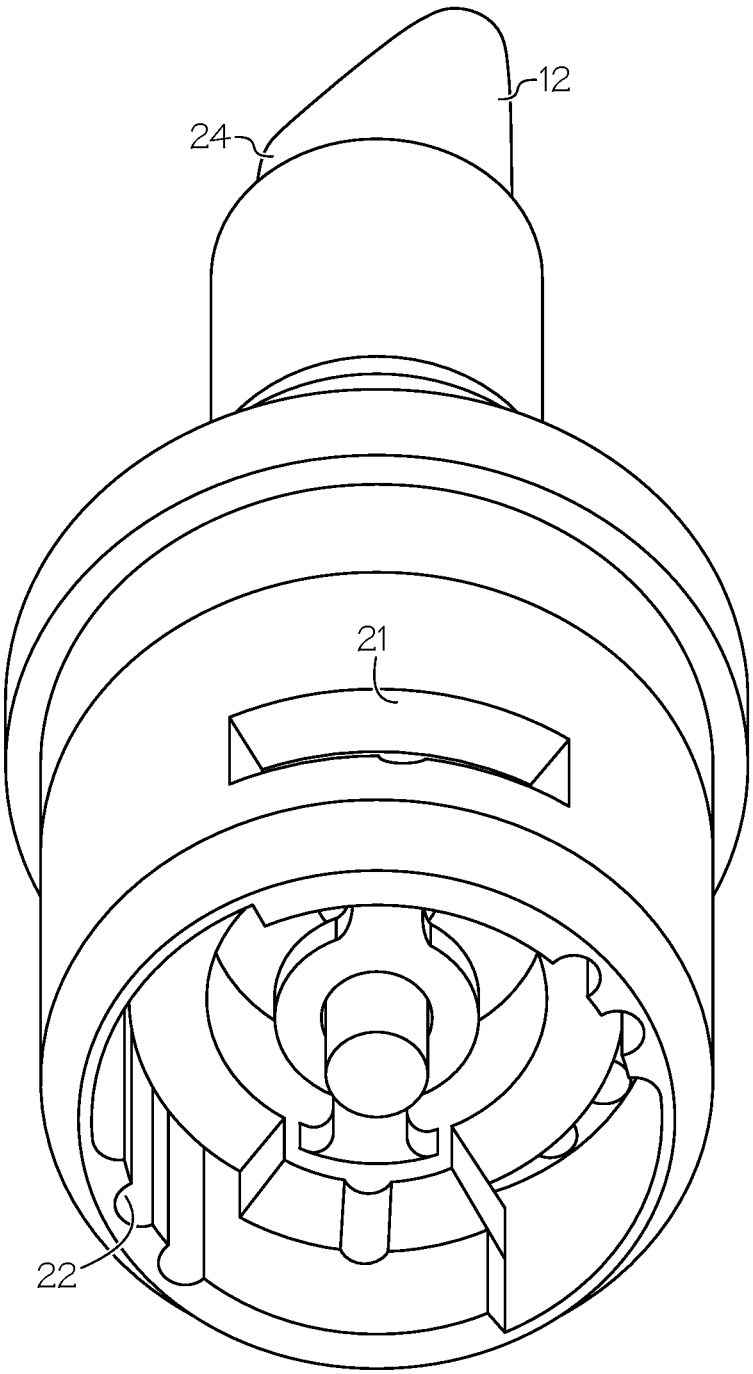
FIG. 3 show the bottom view of FIG. 2.

Referring now to FIG. 3, a bottom view of FIG. 2 is shown. The opening near the bottom is the relief for the catches of the retainer 16 to be inserted to the height of the valve housing windows (see reference numeral 21). The process would be to insert retainer 16 and turn clockwise to lock in place. There is a little detent to keep it from turning back. Also shown is Nib cutout 24, which is a groove which can be sized to optimize desired flow for a specific product. When the nib is pushed in, it opens the valve seal 15 and allow fluid to flow out around the nib 12.

Figure 4:
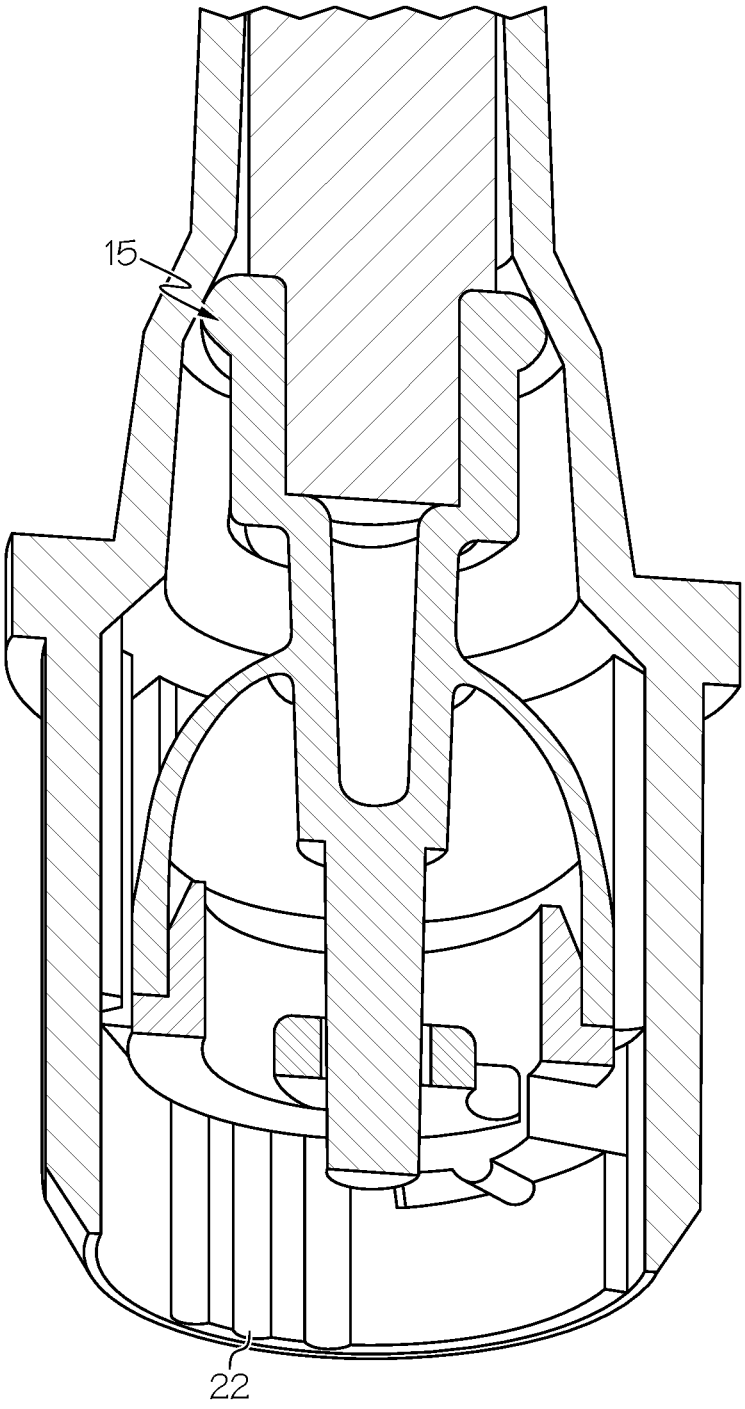
FIG. 4 show a cross-sectional view of FIG. 3.

FIG. 4 show a cross-sectional view of FIG. 3, in which the valve seal 15 is shown, which is created by the elastic button elastically returning to its normally undepressed position after the Nib 12 is depressed, to force the top edge of the spring 17 into contact with the inner wall of valve body 10 at point 15, to prevent the flow of fluid out of the pen dispenser. When the pen dispenser is tipped upside down and the Nib 12 is depressed, the button 14 is elastically deformed against the retainer 16 causing the valve seal 15 to be opened, which permits fluid to flow by gravity around the Nib 12 and out of the pen dispenser. The series of cutouts 22 formed in the valve housing 10 allow fluid to flow from the tube or container, past the retainer 16 and spring/button 14 to valve seal 15.

Figure 5:
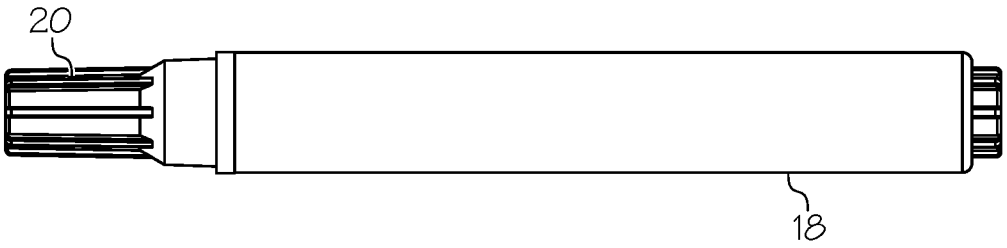
FIG. 5 shows a view of the outside of the pen dispenser.

FIG. 5 shows a view of the outside of the pen dispenser, with an over cap 20, which covers valve housing 10, and a tube 18, which holds the fluid to be dispensed.

Figure 6:
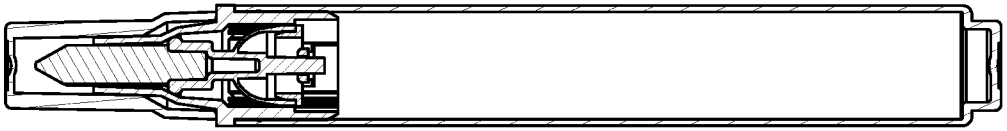
FIG. 6 shows a cross-sectional view of FIG. 5.

FIG. 6 shows a cross-sectional view of FIG. 5.

Figure 7:
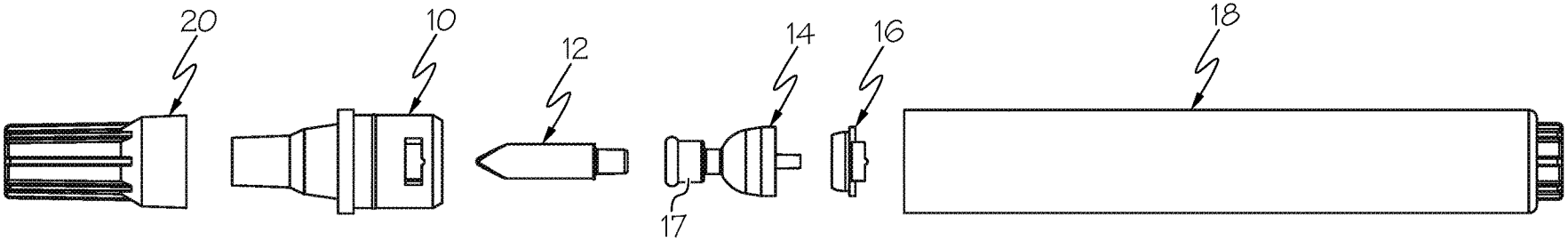
FIG. 7 shows an exploded view of the parts of the pen dispenser.

FIG. 7 shows an exploded view of the parts of the pen dispenser.

Figure 8:
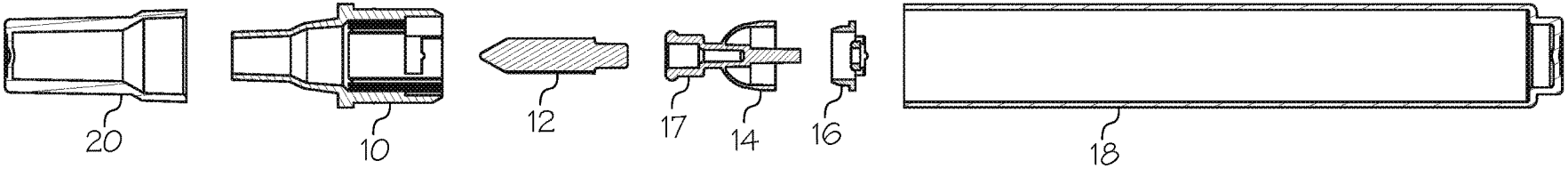
FIG. 8 shows a cross-sectional view of FIG. 7.
Figure 9:
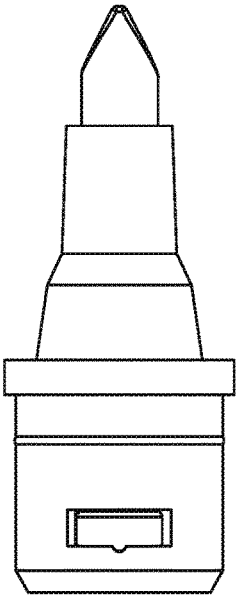
FIG. 9-12 show the valve body and Nib of the pen dispenser rotated and angled in various positions.
Figure 10:
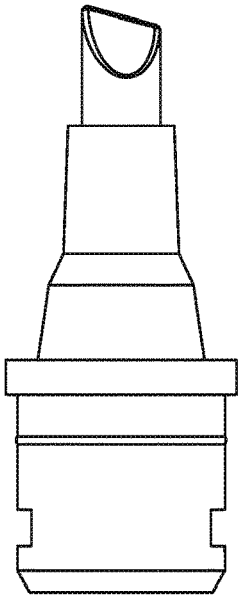
Figure 11:
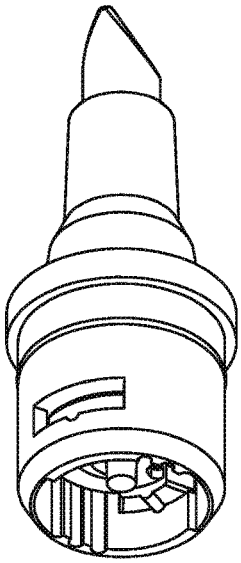
Figure 12:
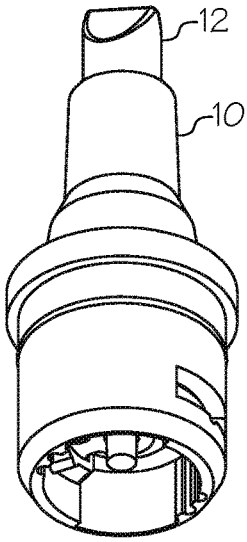

FIG. 8 shows a cross-sectional view of FIG. 7.

FIG. 9-12 show the valve body and Nib of the pen dispenser rotated and angled in various positions.

Figure 13:
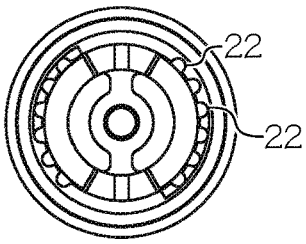
FIG. 13 shows a bottom view, showing the cutouts which allow the fluid to flow by gravity to the Nib end of the pen dispenser.

FIG. 13 shows a bottom view, showing the cutouts 22 which allow the fluid to flow by gravity to the Nib end of the pen dispenser. Basically they are vertical cutouts 22 on the ID (inner diameter) of the housing 10 to allow fluid past the OD (outer diameter) of the Spring 17 and button 14 and the button retainer 16.

Figure 14:
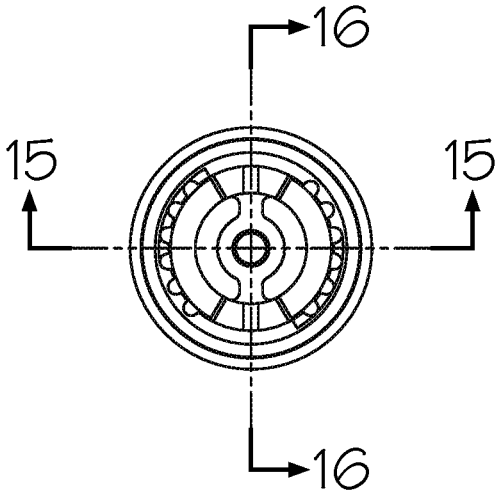
FIG. 14 shows a cross-section view with sections A-A and B-B of the pen dispenser in the closed position.
Figure 15:
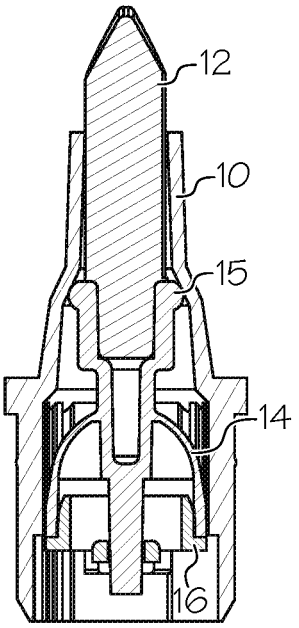
FIG. 15 shows section A-A of FIG. 14.
Figure 16:
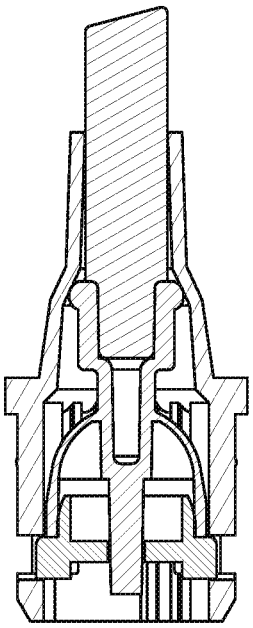
FIG. 16 shows section B-B of FIG. 14.

FIG. 14 shows a cross-section view with sections A-A and B-B of the pen dispenser in the closed position. FIG. 15 shows section A-A of FIG. 14. FIG. 16 shows section B-B of FIG. 14.

Figure 17:
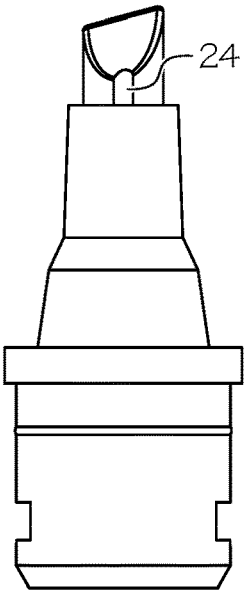
FIG. 17 shows a Nib cutout which controls how fast the fluid flows out of the pen dispenser and shows the pen dispenser in the half-open position.
Figure 18:
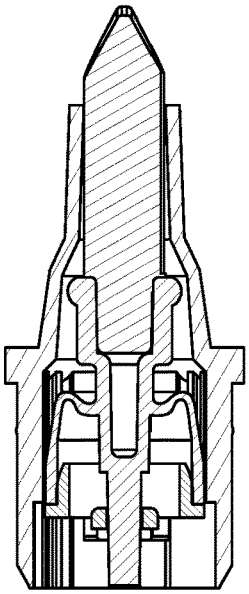
FIG. 18 shows a cross-sectional view of FIG. 17, of the pen dispenser in a half-open position.

FIG. 17 shows a Nib cutout which controls how fast the fluid flows out of the pen dispenser and shows the pen dispenser in the half-open position. FIG. 18 shows a cross-sectional view of FIG. 17, of the pen dispenser in a half-open position.

Figure 19:
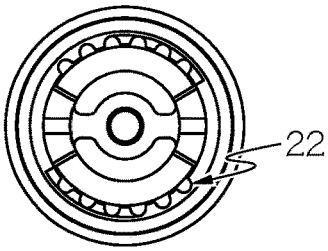
FIG. 19 shows a bottom view of the valve housing, showing the cutouts which provide a flow path past the button retainer, button and spring.

FIG. 19 shows a bottom view of the valve housing, showing the cutouts which provide a flow path past the button retainer, button and spring.

Figure 20:
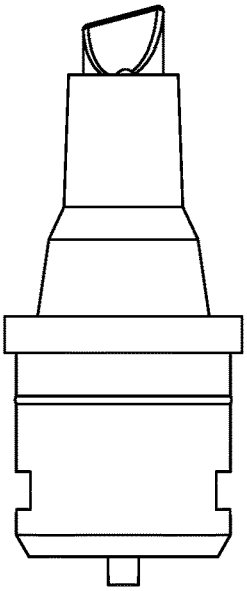
FIG. 20 shows the pen dispenser in the fully open position.
Figure 21:
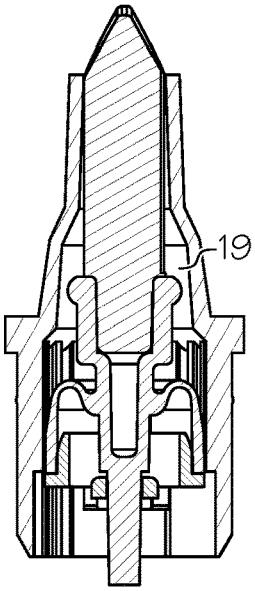
FIG. 21 shows a cross-sectional view of FIG. 20.

FIGS. 20 and 21 show the pen dispenser in the fully open position, with the valve seal 15 opened to allow fluid to pass through (shown at 19).

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A pen dispenser comprising:

a tube having an open top for holding a fluid to be dispensed;

a valve housing made of plastic and having channels on an inner wall;

an applicator nib made of plastic;

a plastic spring actuator having an elastic button, which is connected to the applicator nib, and a button retainer having an outer ledge extending along the entire outer perimeter thereof, wherein a bottom edge of the elastic button engages the outer ledge of the button retainer, whereby in a closed position the plastic spring actuator is sealingly engaged to the valve housing blocking the flow of fluid out around the applicator nib, and in the open position, the plastic spring actuator is depressed so it is no longer sealingly engaged to the valve housing, allowing the fluid to flow through the channels on the inner wall and exit the dispenser around the applicator nib;

wherein the button retainer has two or more projections; and the valve housing has two or more grooves and two or more corresponding ledges; wherein the valve housing is configured to allow the button retainer projections to slide through the housing grooves, the valve housing further configured to allow the valve housing ledges to support the button retainer projections.

2. The pen dispenser of claim 1 wherein the button is made of an elastic thermoplastic elastomer, which when depressed will deform to allow fluid to flow out around the applicator nib, and when the nib is no longer depressed will elastically return to a normally closed position.

3. The pen dispenser of claim 2, wherein the nib has a nib channel configured to allow fluid to flow through the nib channel when the button is in the depressed condition.

4. The pen dispenser of claim 1 wherein the fluid is gravity dispensed.

5. The pen dispenser of claim 1, wherein the outer ledge of the button retainer resistably engages the bottom edge of the elastic button when the plastic spring actuator is depressed.

6. The pen dispenser of claim 1, wherein the plastic spring actuator has a first cavity having a first diameter and a second cavity having a second diameter that is greater than the first diameter, wherein the first and second cavities are connected and the second cavity receives a portion of the nib such that the first cavity is closed off when the portion of the nib is positioned in the second cavity.

7. The pen dispenser of claim 1, wherein one or more of the button retainer projections has an anti-rotation bump and wherein one or more of the valve housing ledges has a corresponding ledge detent, wherein the anti-rotation bump is configured to fit into the ledge detent in an installed condition.

8. The pen dispenser of claim 1, wherein the valve housing further comprises two or more housing windows wherein the valve housing ledges extend from the housing windows.

9. The pen dispenser of claim 8, wherein the valve housing channels are located between the housing windows.

* * * * *